US007934719B2

(12) United States Patent
Tratar

(10) Patent No.: US 7,934,719 B2
(45) Date of Patent: May 3, 2011

(54) DOCUMENT FEEDER FLAG ASSEMBLY

(75) Inventor: David B. Tratar, Dearborn, MI (US)

(73) Assignee: Burroughs Payment Systems, Inc., Plymouth, MI (US)

( * ) Notice: Subject to any disclaimer, the term of this patent is extended or adjusted under 35 U.S.C. 154(b) by 0 days.

(21) Appl. No.: 11/950,482

(22) Filed: Dec. 5, 2007

(65) Prior Publication Data

US 2009/0146361 A1 Jun. 11, 2009

(51) Int. Cl.
*B65H 3/04* (2006.01)
*B65H 3/52* (2006.01)

(52) U.S. Cl. ..... 271/35; 271/122; 271/124; 271/160; 271/137; 271/138

(58) Field of Classification Search ..... 271/131, 271/35, 23, 165, 138, 122, 121, 124, 137, 271/160
See application file for complete search history.

(56) References Cited

U.S. PATENT DOCUMENTS 4,909,499 A * 3/1990 O'Brien et al. ..... 271/10.06
6,971,645 B2 * 12/2005 Coret et al. ..... 271/138
* cited by examiner

*Primary Examiner* — Stefanos Karmis
*Assistant Examiner* — Luis Gonzalez
(74) *Attorney, Agent, or Firm* — Honigman Miller Schwartz and Cohn LLP

(57) ABSTRACT

An improved document feeder flag assembly is disclosed. The improved document feeder flag assembly allows single handed, on the fly loading of a document sorter. A method for loading a document sorting machine with a single hand, while the method of operating the machine is also disclosed. The document feeder flag assembly includes a baseplate and a pivot post attached to the baseplate. Further, the assembly includes a flag arm having a first side and a second side, the first side of the flag arm is attached to the pivot post. There is also a feeder flag having a first side and a second side, the first side of the feeder flag being attached to a second side of the flag arm. The document feeder flag assembly also includes a resistance device attached between the feeder flag and the flag arm.

19 Claims, 6 Drawing Sheets

TOP VIEW - BOTH COVERS REMOVED
DOCUMENTS SHOW A FULL FEEDER

TOP VIEW - BOTH COVERS REMOVED

TOP VIEW - BOTH COVERS REMOVED
DOCUMENTS SHOW A FULL FEEDER

DOCUMENT FEEDER FLAG ASSEMBLY

TECHNICAL FIELD

The present disclosure relates to a document feeder flag assembly. More particularly, the present disclosure relates to an improved document feeder flag assembly, allowing on the fly, single handed document loading.

BACKGROUND

Modern table top sorters implement a variety of different approaches to feeding documents out of a hopper and onto a track or document path. Typical systems for feeding and transporting documents require feeding systems to feed documents in order, one at a time, from a stack in a hopper. These systems often include a nudger component to nudge the documents from the hopper into the feeder.

Many large document sorters require feeder flag assemblies, which are essentially mechanisms used to push against a stack of documents in a hopper, forcing the documents up against the feeder/roller/nudger arrangement. Typically, an operator fills a hopper by taking a stack of around 100 to 200 documents in one hand and manually moving a flag with the other free hand to provide space in the hopper to load the document. Filling hoppers in this manner is somewhat tedious, requiring two hands to complete.

Also, due to size constraints of table top sorters, the ability to use designs from the larger document sorters, which allow for on the fly loading, is impractical and far too pricey. Another area of concern in these table top machines is assembly requirements. Larger document sorter designs usually require an assembly line worker to affix components both above and below the baseplate, which slows down assembly time. Furthermore, designs requiring combined top and bottom assembly also require some form of through hole or slot for the mechanism to operate. Through holes and slots can add to document handling problems, causing documents to skew or tear and machines to slow down or hang. Because these designs require access to the bottom of the baseplate for assembly, component replacement requires extra disassembly of the sorter.

For these and other reasons, improvements are desirable.

SUMMARY

In accordance with the present disclosure, the above and other problems are solved by the following:

In a first aspect, a document feeder flag assembly is disclosed. The document feeder flag assembly includes a baseplate and a pivot post attached to the baseplate. Further, there is a flag arm having a first side and a second side, the first side of the flag arm is attached to the pivot post. There is also a feeder flag having a first side and a second side, the first side of the feeder flag being attached to a second side of the flag arm. The document feeder flag assembly also includes a resistance device attached between the feeder flag and the flag arm.

In a second aspect, a document processing machine is disclosed. The disclosed document processing machine allows operators to load documents into a hopper with one hand while the machine is operational. The document processing machine includes means for allowing documents to be loaded into a hopper with one hand and means for pushing documents in a hopper against a feeder mechanism.

In a third aspect, a method for loading a running document processing machine with one hand is disclosed. The method includes creating a wedge shape between a flag arm in a document feeder flag assembly and a loaded stack of documents in a hopper, then grasping an unloaded stack of documents with one hand. Next, the unloaded stack of documents is slid into the wedge shape between the feeder arm and the loaded stack of documents in the hopper, thereby displacing the feeder flag assembly, thereby loading the unloaded stack of documents into the machine.

In a fourth aspect, a document feeder flag assembly is disclosed. The assembly includes a baseplate and a document surface connected to the baseplate. The assembly further includes at least one first member connected to the baseplate, wherein the first member remains in an orientation generally parallel to the document surface. The assembly also includes at least one second member connected to the first member, wherein the second member changes its orientation relative to the first member and surface, thereby creating a space between the surface and the second member.

DETAILED DESCRIPTION

Figure 1:
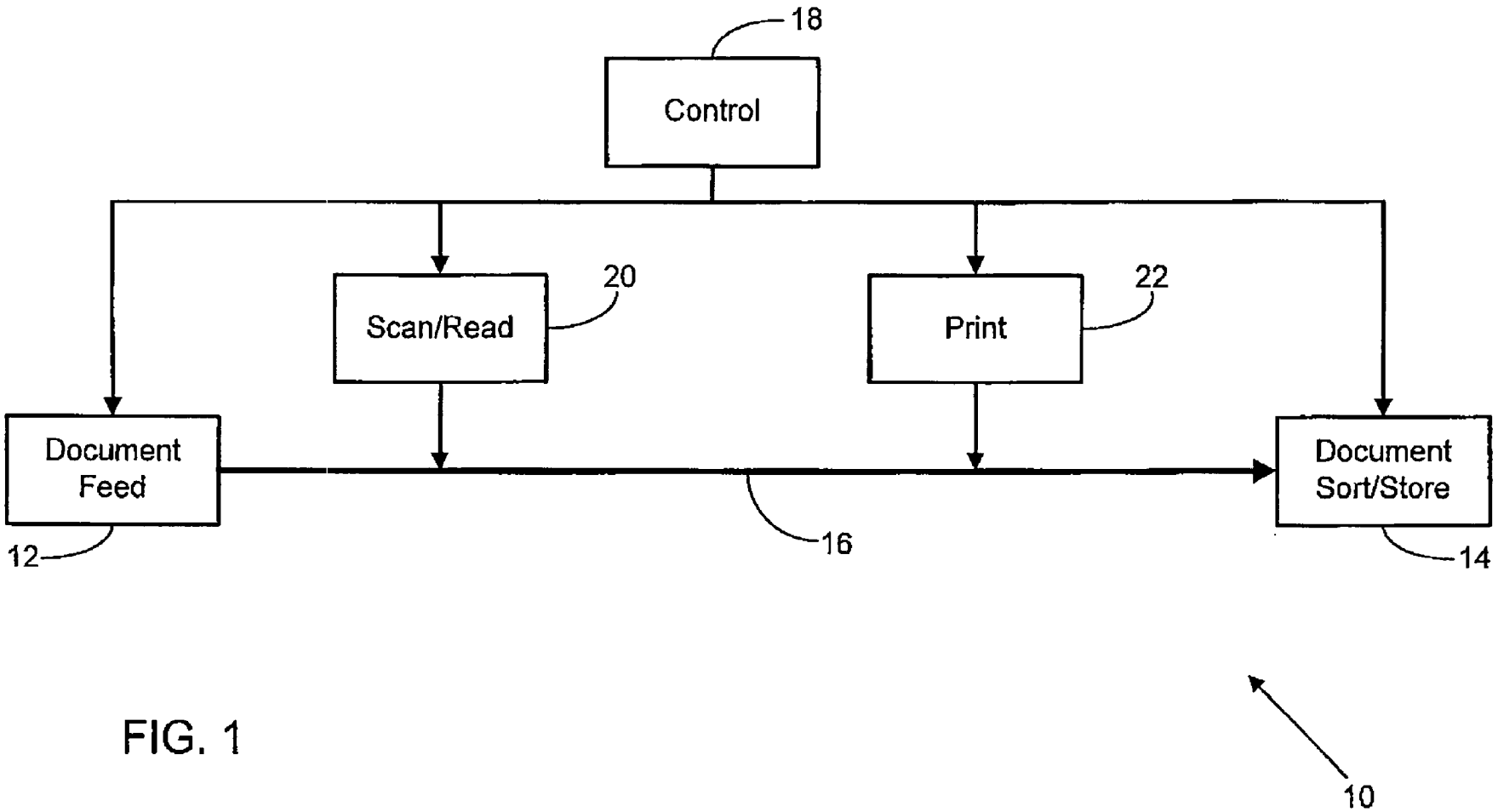
FIG. 1 shows a schematic block diagram of a document processing system in which aspects of the present disclosure can be implemented.

Various embodiments of the present disclosure will be described in detail with reference to the drawings, wherein like reference numerals represent like parts and assemblies throughout the several views. Reference to various embodiments does not limit the scope of the invention, which is limited only by the scope of the claims attached hereto. Additionally, any examples set forth in this specification are not intended to be limiting and merely set forth some of the many possible embodiments for the claimed invention.

In general, the present disclosure relates to an improved document feeder flag assembly to be used in a document sorter or other document processing machine. The improved document feeder flag allows for single handed loading of documents into a document hopper by using an innovative flag design.

Referring now to FIG. 1, an automated document processing system 10 is shown in which aspects of the present disclosure can be implemented. The automated document processing system 10 provides an overview of the basic steps required to process documents, such as checks, in a high-volume system in which user supervision is minimized. In one embodiment, the automated document processing system 10 is a check processing system used to print and scan checks at a financial institution or document processing company. In still other embodiments, the automated document processing system 10 is a document sorter or other generalized document management system.

The automated document processing system 10 includes a document feeder 12 interconnected with a document sorter 14 along a path of travel 16 of documents. The document feeder 12 is generally a document take-up mechanism provided with a large number of documents that are required to be processed. The document feeder 12 generally selects a document from a stack of documents for insertion into the path of travel 16 of the automated document processing system 10. The document feeder 12 generally includes a feeder flag assembly arranged to guide documents into the automated document processing system 10. Further details regarding a possible implementation of the document feeder 12 are described in conjunction with FIGS. 2-6, below.

The document sorter 14 is an endpoint at which the documents have been processed, and can include one or more sorting mechanisms configured to arrange physical documents in a desired manner The path of travel 16 may be defined by any of a number of document movement and/or guiding mechanisms, such as rollers, guides, or other systems able to grip and move documents from the document feeder 12 to the document sorter 14.

A control system 18 is interconnected to the document feeder 12 and the document sorter 14 to control flow of documents along the path of travel 16. The control system 18 can be an application level program configured to control flow and processing of documents. The control system 18 can reside on a general purpose or specific purpose computing system capable of communicating with the document feeder 12 and document sorter 14.

The control system 18 directs a number of document processing tasks to be performed by the automated document processing system 10, as designated and/or selected by user requirements. In the embodiment shown, the automated document processing system 10 includes a scanning system 20 and a printing system 22, directed by the control system 18. The scanning system 20 can scan one side of the documents passing along the path of travel 16, to store text and/or images displayed on the documents. The printing system 22 prints desired characters and/or images onto documents passing by the printing system along the path of travel 16. The printing system 22 can incorporate a print assembly which is configured to print from a stationary printing aperture onto moving documents passing by the printing system along the path of travel. In the example of a check processing system, the printing system 22 can print an endorsement onto the back of a check which is being processed at a financial institution operating the automated document processing system 10. Other functionality may be incorporated into the automated document processing system 10, and other documents may be processed as well, by financial institutions or other document processing entities.

By passing documents through the automated document processing system 10, a large volume of documents can be processed. In the embodiment shown, the documents can receive printing and be electronically captured, such that various records can be stored for each of a large number of documents. In the case of a financial institution processing checks or other documents, that institution can endorse a large number of checks, can capture check images and routing information, and can appropriately sort each document for distribution back to its issuing institution.

Figure 2:
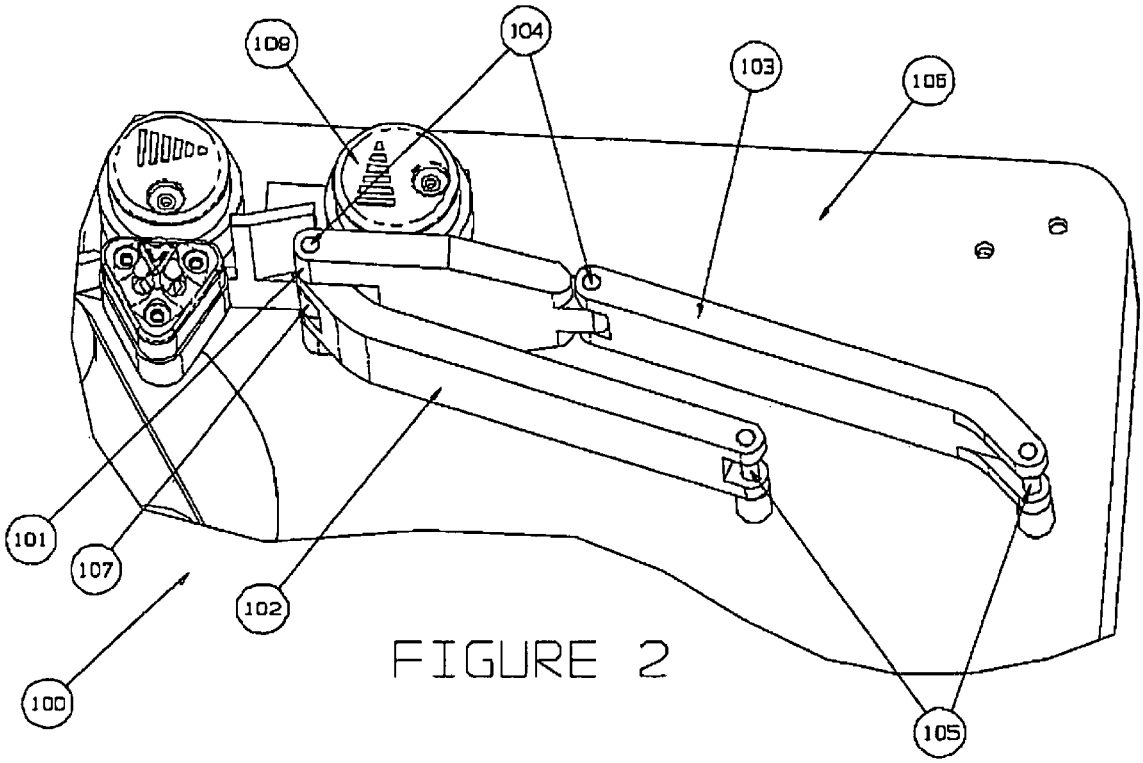
FIG. 2 shows a perspective schematic view of a specific implementation of the improved document feeder flag assembly described in this disclosure.
Figure 3:
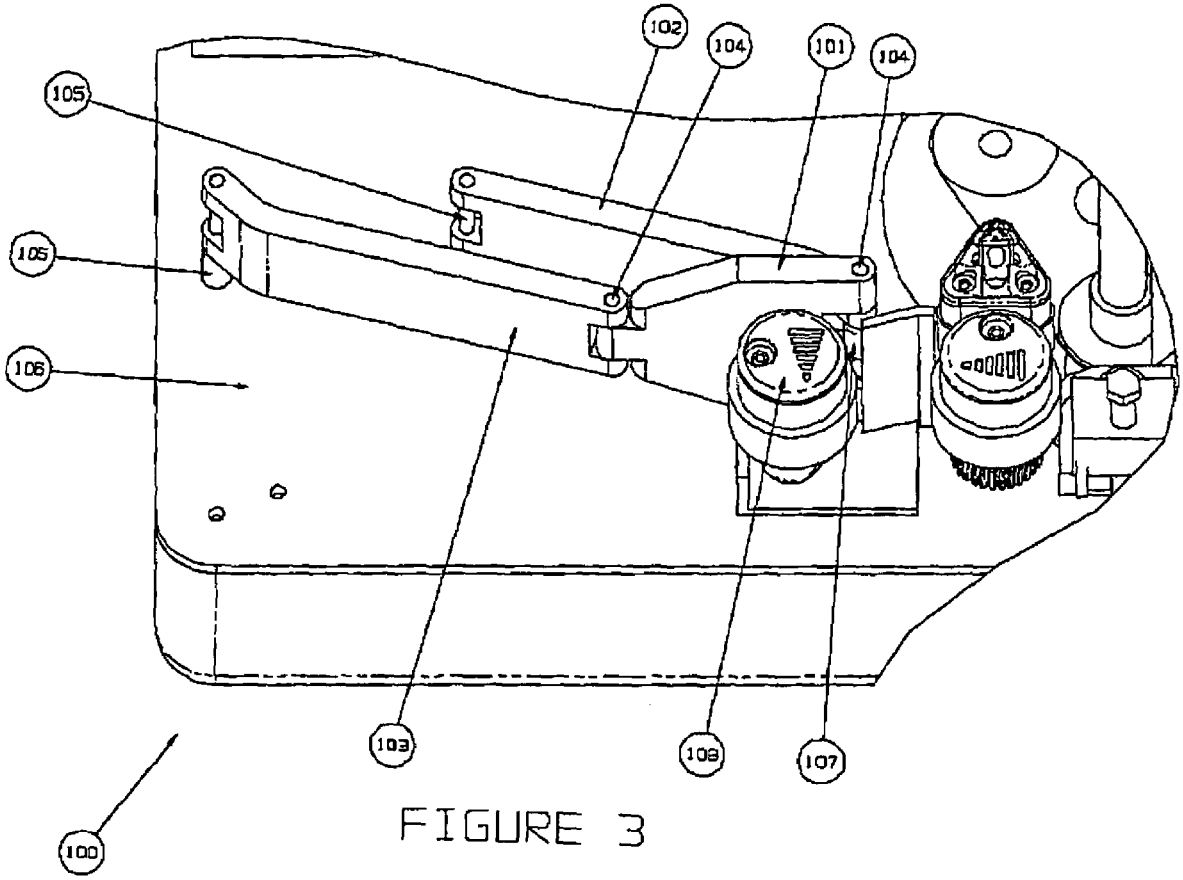
FIG. 3 shows another perspective schematic view of a specific implementation of the improved document feeder flag assembly described in this disclosure.
Figure 4:
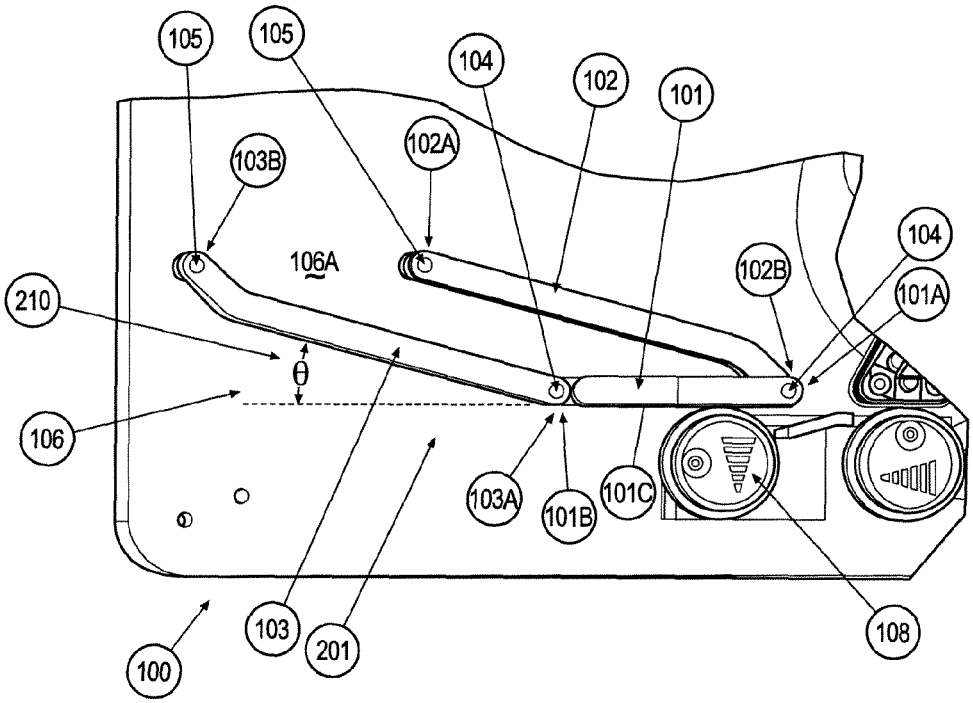
FIG. 4 is a top view schematic depiction of a specific implementation of the improved document feeder flag assembly described in this disclosure in the feeder empty position.
Figure 5:
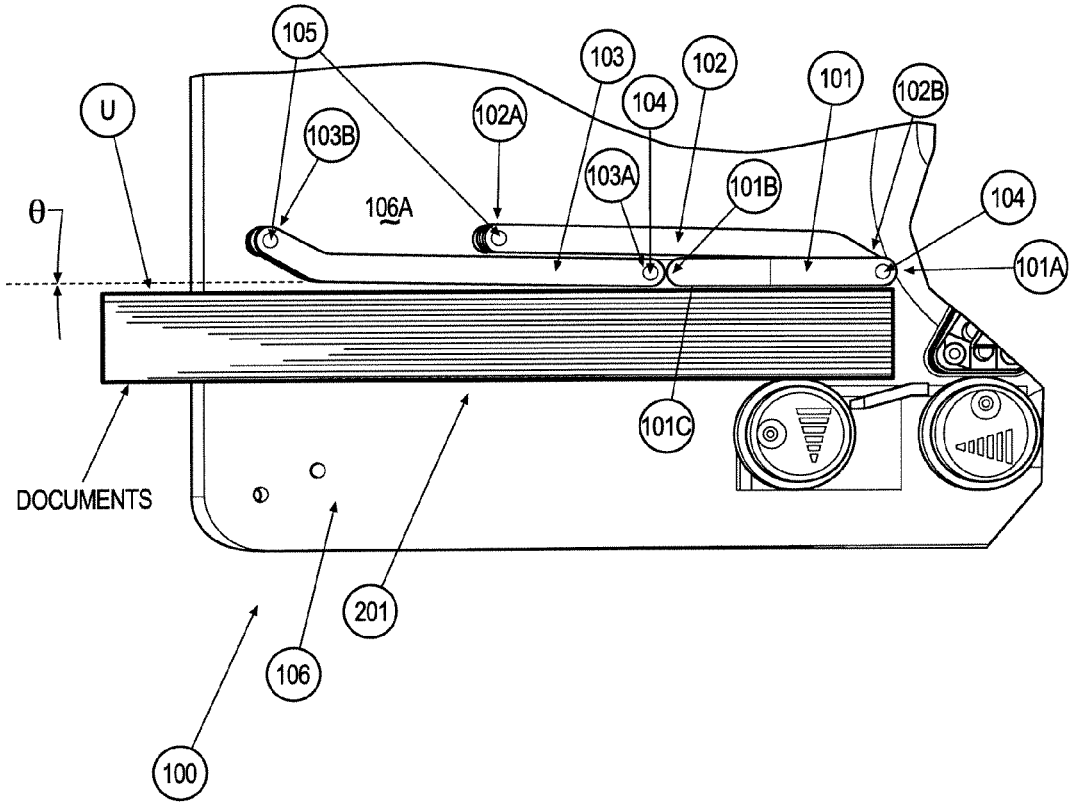
FIG. 5 is a top view schematic depiction of a specific implementation of the improved document feeder flag assembly described in this disclosure in the feeder full position.

FIG. 2 and FIG. 3 show two perspective views of a specific example of an improved document feeder flag assembly 100 in accordance with the present disclosure. A feeder flag 101 touches an upper surface, U, of a stack of documents (see, e.g., FIG. 5) in a hopper (not shown). A first flag arm/front flag arm 102, which includes a first end 102*a* and a second end 102*b* (see, e.g., FIGS. 4 and 5), is hingedly attached to the side of feeder flag 101 which extends into the document processing system to guide the document into a path of travel. A second flag arm/back flag arm 103, which includes a first end 103*a* and a second end 103*b* (see, e.g., FIGS. 4 and 5), is hingedly attached to the side of feeder flag 101 which extends adjacent to a stack of documents within the hopper. Dowel pins 104 may be used to attach a first end 101*a* (see e.g., FIGS. 4 and 5) of the feeder flag 101 to the second end 102*b* of the front flag arm 102 and a second end 101*b* (see, e.g., FIGS. 4 and 5) of the feeder flag 101 to the first end 103*a* of the back flag arm 103. As seen in FIGS. 4 and 5, the other ends 102*a*, 103*b* of front flag arm 102 and back flag arm 103 are attached to posts 105. Posts 105 are attached to an attachment surface 106*a*/top surface of a baseplate 106. A spring 107, or other suitable apparatus, is used to create resistance forcing the feeder flag 101 against the upper surface, U, of the stack of documents in the hopper. This resistance created by spring 107 is sufficient to keep the documents in the hopper properly against a document feeder/nudger assembly 108 and a document-touching surface 101*c* of the feeder flag 101 (see, e.g., FIG. 5).

FIG. 4 shows a schematic top view demonstrating positions of various parts of feeder flag assembly 100 when a document hopper 201 is empty and feeder flag assembly 100 is in an empty position. It can be seen by FIG. 3 that when document hopper 201 is empty, both front flag arm 102 and back flag arm 103 are forced by the tension of spring 107 to push feeder flag 101 against document feeder/nudger assembly 108. When document hopper 201 is empty, both front flag arm 102 and back flag arm 103 are angled from posts 105 toward document feeder/nudger assembly 108. The space between back flag arm 103 and the opposing side of the document hopper makes wedge shape 210.

FIG. 5 shows a schematic top view demonstrating positions of various parts of feeder flag assembly 100 of FIG. 1 when document hopper 201 is full and feeder flag assembly 100 is in the full position. It can be seen by FIG. 4 that when the document hopper 201 is full, both front flag arm 102 and back flag arm 103 lie in planes parallel to the documents in document hopper 201. Further, in the full position of this specific example, back flag arm 103 and feeder flag 101 lie generally serially in relation to one another and both lie in a generally parallel position with front flag arm 102.

From the full position, documents are fed one by one into the document processing system. As the documents are fed, the resistance of feeder flag assembly 100 continues to press against the document stack as it gradually gets smaller. As the stack gets smaller, feeder flag 101 continues to press against the documents and is positioned in a direction generally parallel to the document stack, though both front flag arm 102 and back flag arm 103 are at angles relative to feeder flag 101 and the document stack. The difference in angles between the stack of documents and feeder flag 101, and both front flag arm 102 and back flag arm 103, continues to get larger as the document stack continues to diminish in size. Eventually, if document hopper 201 is not refilled with more documents, all the documents would be fed out of document hopper 201, leaving it empty as shown in FIG. 4.

Figure 6:
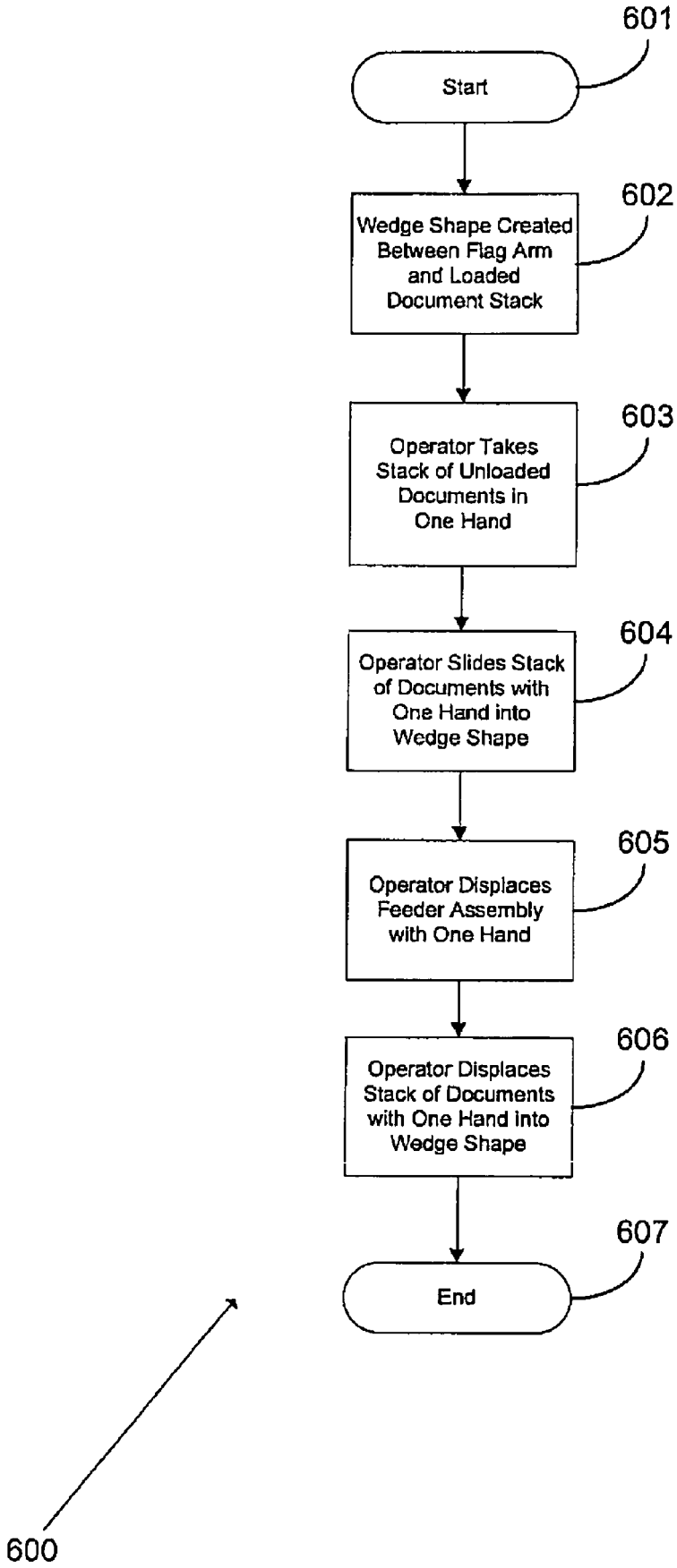
FIG. 6 is a flow diagram demonstrating a method of loading a document feeder with one hand in accordance with the present disclosure.

FIG. 6 shows a method of loading a document feeder, implementing an improved document feeder flag assembly in accordance with this disclosure. This method begins at Start 601. At Wedge Creation Step 602, wedge shape 210 is created by the space between back flag arm 103 and the document stack as the document stack gets smaller in document hopper 201. One having skill in the art would recognize that wedge shape 210 can be created by the space between back flag arm 103 and the opposing side of document hopper 201 if document hopper 201 is empty. Wedge shape 210 facilitates one handed loading of document hopper 201. At Unloaded Document Step 603, the operator takes a stack of unloaded documents in one hand. Next, at Wedge Slide Step 604, the operator slides the unloaded documents into wedge shape 210 with one hand, thereby displacing feeder flag assembly 100 at Assembly Displacement Step 605. This results in the operator placing the stack of unloaded documents on top of the already loaded documents in document hopper 201, at Document Placement Step 606 thereby loading the documents and ending the method at End 607.

The document feeder flag assembly described herein can be located within a variety of types of document processing systems, beyond the one described above in FIG. 1. For example, various printing systems or document sorting systems may incorporate such a feeder flag assembly.

The above specification, examples and data provide a complete description of the manufacture and use of the composition of the invention. Since many embodiments of the invention can be made without departing from the spirit and scope of the invention, the invention resides in the claims hereinafter appended.

The invention claimed is:

1. A document feeder flag assembly, comprising:

a baseplate having an attachment surface;

a first post attached to the attachment surface of the baseplate;

a second post attached to the attachment surface of the baseplate; and an arm linkage assembly that is pivotably adjustable to be in one of an expanded orientation, and a collapsed orientation, wherein the arm linkage assembly is attached to the first post and the second post, wherein the arm linkage assembly includes: a first flag arm having a first end and a second end, wherein the first end of the first flag arm is pivotably-attached to the first post, a feeder flag arm having a first end and a second end, wherein the first end of the feeder flag arm is pivotably-coupled to the second end of the first flag arm by a first dowel pin, a second flag arm having a first end and a second end, wherein the first end of the second flag arm is pivotably-coupled to the second end of the feeder flag arm by a second dowel pin, wherein the second end of the second flag arm is pivotably-attached to the second post, wherein the second flag arm is angularly arranged relative the feeder flag arm at an angle, θ, wherein the angle, θ, is approximately equal to about zero degrees when the arm linkage assembly is pivotably-adjusted to be in the collapsed orientation, wherein the angle, θ, is approximately greater than about zero degrees when the arm linkage assembly is pivotably-adjusted to be in the expanded orientation.

2. The document feeder flag assembly of claim 1 further comprising a resistance device attached to the feeder flag arm and the first flag arm, wherein the resistance device is located between the first flag arm and the feeder flag arm, wherein the resistance device includes a spring that provides means for biasing the arm linkage assembly from the collapsed orientation to the expanded orientation.

3. The document feeder flag assembly of claim 2, wherein the spring further provides means for biasing the feeder flag arm toward a document feeder/nudger assembly.

4. The document feeder flag assembly of claim 1, wherein the baseplate, the first post, the second post and the arm linkage assembly are arranged within a document hopper, wherein, the document hopper is a reservoir that houses one or more documents, wherein the one or more documents form a stack of documents, wherein the feeder flag arm includes a document-contacting surface, wherein the document-contacting surface contacts an upper surface of the one or more documents forming the stack of documents that is housed within the document hopper.

5. The document feeder flag assembly of claim 1, wherein the baseplate, the first post, the second post and the arm linkage assembly are arranged within a document hopper, wherein, the document hopper is a reservoir for storing one or more documents, wherein, when the angle, θ, is approximately equal to about zero degrees, the document hopper is at least partially empty and stores none or few documents.

6. The document feeder flag assembly of claim 1, wherein the baseplate, the first post, the second post and the arm linkage assembly are arranged within a document hopper, wherein, the document hopper is a reservoir for storing one or more documents, wherein, when the angle, θ, is approximately greater than about zero degrees, the document hopper is at least partially full and stores the one or more documents.

7. The document feeder flag assembly of claim 1, wherein, when the arm linkage assembly is pivotably adjustable to be in the collapsed orientation, both of the feeder flag arm and the second flag arm are parallel to an upper surface of at least one document of a stack of documents in a document hopper.

8. A document feeder flag assembly, comprising:

a baseplate having an attachment surface;

a first post attached to the attachment surface of the baseplate;

a second post attached to the attachment surface of the baseplate; and an arm linkage assembly that is pivotably adjustable to be in one of an expanded orientation, and a collapsed orientation, wherein the arm linkage assembly is attached to the first post and the second post, wherein the arm linkage assembly includes: a first flag arm having a first end and a second end, wherein the first end of the first flag arm is pivotably-attached to the first post, a feeder flag arm having a first end and a second end, wherein the first end of the feeder flag arm is pivotably-coupled to the second end of the first flag arm by a first dowel pin, a second flag arm having a first end and a second end, wherein the first end of the second flag arm is pivotably-coupled to the second end of the feeder flag arm by a second dowel pin, wherein the second end of the second flag arm is pivotably-attached to the second post, wherein, when the arm linkage assembly is pivotably adjustable to be in the collapsed orientation, both of the feeder flag arm and the second flag arm lie generally serially in relation to one another and are generally parallel with respect to the first flag arm.

9. The document feeder flag assembly of claim 8, further comprising:

a resistance device attached to the feeder flag arm and the first flag arm, wherein the resistance device is located between the first flag arm and the feeder flag arm, wherein the resistance device includes a spring that provides means for biasing the arm linkage assembly from the collapsed orientation to the expanded orientation.

10. The document feeder flag assembly of claim 9, wherein the spring further provides:

means for biasing the feeder flag arm toward a document feeder/nudger assembly.

11. The document feeder flag assembly of claim 8, wherein the baseplate, the first post, the second post and the linkage assembly are arranged within a document hopper, wherein, the document hopper is a reservoir that houses one or more documents, wherein the one or more documents form a stack of documents, wherein the feeder flag arm includes a document-contacting surface, wherein the document-contacting surface contacts an upper surface of the one or more documents foaming the stack of documents that is housed within the document hopper.

12. The document feeder flag assembly of claim 8, wherein, when the arm linkage assembly is pivotably adjustable to be in the collapsed orientation, both of the feeder flag arm and the second flag arm are parallel to an upper surface of at least one document of a stack of documents in a document hopper.

13. A document feeder flag assembly, comprising:

a baseplate having an attachment surface;

a first post attached to the attachment surface of the baseplate;

a second post attached to the attachment surface of the baseplate;

an arm linkage assembly that is pivotably adjustable to be in one of an expanded orientation, and a collapsed orientation, wherein the arm linkage assembly is attached to the first post and the second post, wherein the arm linkage assembly includes: a first flag arm having a first end and a second end, wherein the first end of the first flag arm is pivotably-attached to the first post, a feeder flag arm having a first end and a second end, wherein the first end of the feeder flag arm is pivotably-coupled to the second end of the first flag arm by a first dowel pin, a second flag arm having a first end and a second end, wherein the first end of the second flag arm is pivotably-coupled to the second end of the feeder flag arm by a second dowel pin, wherein the second end of the second flag arm is pivotably-attached to the second post; and a resistance device attached to the feeder flag arm and the first flag arm, wherein the resistance device is located between the first flag arm and the feeder flag arm, wherein the resistance device includes a spring that provides means for biasing the arm linkage assembly from the collapsed orientation to the expanded orientation.

14. The document feeder flag assembly of claim 13, wherein the spring further provides:

means for biasing the feeder flag arm toward a document feeder/nudger assembly.

15. The document feeder flag assembly of claim 13, wherein the baseplate, the first post, the second post and the arm linkage assembly are arranged within a document hopper, wherein, the document hopper is a reservoir that houses one or more documents, wherein the one or more documents form a stack of documents, wherein the feeder flag arm includes a document-contacting surface, wherein the document-contacting surface contacts an upper surface of the one or more documents forming the stack of documents that is housed within the document hopper.

16. The document feeder flag assembly of claim 13, wherein the second flag arm is angularly arranged relative the feeder flag arm at, an angle, θ, wherein the angle, θ, is approximately equal to about zero degrees when the arm linkage assembly is pivotably-adjusted to be in the collapsed orientation, wherein the angle, θ, is approximately greater than about zero degrees when the arm linkage assembly is pivotably-adjusted to be in the expanded orientation.

17. The document feeder flag assembly of claim 16, wherein the baseplate, the first post, the second post and the arm linkage assembly are arranged within a document hopper, wherein, the document hopper is a reservoir for storing one or more documents, wherein, when the angle, θ, is approximately equal to about zero degrees, the document hopper is at least partially empty and stores none or few documents.

18. The document feeder flag assembly of claim 16, wherein the baseplate, the first post, the second post and the arm linkage assembly are arranged within a document hopper, wherein, the document hopper is a reservoir for storing one or more documents, wherein, when the angle, θ, is approximately greater than about zero degrees, the document hopper is at least partially full and stores the one or more documents.

19. The document feeder flag assembly of claim 13, wherein, when the arm linkage assembly is pivotably adjustable to be in the collapsed orientation, both of the feeder flag arm and the second flag arm are parallel to an upper surface of at least one document of a stack of documents in a document hopper.

* * * * *

UNITED STATES PATENT AND TRADEMARK OFFICE

CERTIFICATE OF CORRECTION

PATENT NO. : 7,934,719 B2
APPLICATION NO. : 11/950482
DATED : May 3, 2011
INVENTOR(S) : David B. Tratar It is certified that error appears in the above-identified patent and that said Letters Patent is hereby corrected as shown below:

In the Claims:

Please correct Claim 11 as follows:

Column 7, claim number 11, line number 13, delete “foaming” and insert -- forming --.

Signed and Sealed this
Fourteenth Day of February, 2012

David J. Kappos

David J. Kappos
*Director of the United States Patent and Trademark Office*